US005299508A

United States Patent [19]

Connelly

[11] Patent Number: 5,299,508

[45] Date of Patent: Apr. 5, 1994

[54] RAILROAD CAR DOOR CLOSURE HAVING TRACKSIDE MOUNTED PLURAL ACTUATING ARMS

[75] Inventor: Jerry Connelly, Bluefield, W. Va.

[73] Assignee: Clinch River Corporation, Tazewell, Va.

[21] Appl. No.: 997,581

[22] Filed: Dec. 28, 1992

[51] Int. Cl.[5] ..... B61D 7/30

[52] U.S. Cl. ..... 105/241.2; 105/286; 105/288; 414/387

[58] Field of Search ..... 105/241.2, 286, 288, 105/289, 296, 304, 306; 414/376, 387, 402; 16/71

[56] References Cited

U.S. PATENT DOCUMENTS

| | | | |
|---|---|---|---|
| 2,623,476 | 12/1952 | Corrigan et al. | 414/376 X |
| 3,836,023 | 9/1974 | Peterson et al. | 105/241.2 |
| 3,939,996 | 2/1976 | Golob et al. | 414/509 |
| 4,011,956 | 3/1977 | Green et al. | 105/241.2 X |
| 4,120,412 | 10/1978 | Miller et al. | 414/387 |
| 4,235,169 | 11/1980 | Peterson | 105/251 |
| 4,522,545 | 6/1985 | Peckham | 414/376 |

FOREIGN PATENT DOCUMENTS

| | | | |
|---|---|---|---|
| 1049310 | 10/1983 | U.S.S.R. | 105/241.2 |
| 1081042 | 3/1984 | U.S.S.R. | 105/241.2 |
| 1411191 | 7/1988 | U.S.S.R. | 105/241.2 |
| 1572880 | 6/1990 | U.S.S.R. | 105/286 |
| 1661021 | 7/1991 | U.S.S.R. | 105/241.2 |

*Primary Examiner*—Robert J. Oberleitner
*Assistant Examiner*—S. Joseph Morano
*Attorney, Agent, or Firm*—Cushman, Darby & Cushman

[57] ABSTRACT

A closer for closing the doors of a railroad hopper car has two closer assemblies. The assemblies are mounted adjacent to each rail of a track on a frame which passes below and between the rails. Each assembly includes a hydraulic closer jack, a hydraulic lifting jack and a hydraulic swing motor for orienting the closer jack relative to a door. The jack is extendable to contact a door and push it to a closed position. The jack assemblies can be pivoted 180° by the swing motor to close the door of the forward car and then the rearward car without having to reposition the train.

14 Claims, 4 Drawing Sheets

RAILROAD CAR DOOR CLOSURE HAVING TRACKSIDE MOUNTED PLURAL ACTUATING ARMS

BACKGROUND OF THE INVENTION

Field of the Invention

The invention relates to a device for closing railroad car doors. More specifically, the device is for closing standard forward and rearward facing doors of a hopper car to a position where the doors can be readily latched. In the open position, the doors hang vertically from horizontal hinges at the top of the door. In the closed position, the doors are latched so that the lower edge is inward of the upper hinge.

When railroad coal cars arrive at a delivery site and are emptied of their contents through their doors, the doors must be closed before the cars are reloaded or moved from the site. The metal doors are heavy and hang in an open position. Frequently, railroad cars are old and the doors and hinges are worn from weather and use. Commonly, car doors and hinges are frozen, dirty, damaged and lacking lubrication. Doors in such a condition are difficult or impossible to close manually. Moreover, closing the doors manually requires the worker to be under the rail car and occasionally, workers are injured when the doors do not close completely, fail to latch, and then swing back into the worker.

SUMMARY OF THE INVENTION

An object of the present invention is to provide a means for closing end doors of a stationary rail car. The closer must supply sufficient force to close dirty, damaged, and or frozen doors so that manual assistance is not necessary. Another object of the invention is to avoid the risk of injuries resulting from manually closing doors and eliminate the need for a worker to be under the rail car to close the doors.

The foregoing and other objects of the invention are realized by providing a rail car door closer having two hydraulic closer assemblies. The two assemblies are mounted on a frame which in turn is mounted on a solid foundation located beneath the rails of a railroad track. The two assemblies are located at the ends of the frame just outside of the track with the frame extending perpendicularly between and under the rails. The closer assemblies each have a closer arm which is movable by remote control which allow independent movement of each arm. The closer assemblies are powered by a hydraulic power pack or electricity and are controlled by two control banks to provide motion in three dimensions to the ends of the closer arms located respectively on each side of the track. The closer arms are positioned and then extended to contact the door and push the door into a closed position.

Other objects, features, and characteristics of the present invention as well as the methods of operation and function of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE INVENTION

Figure 1:
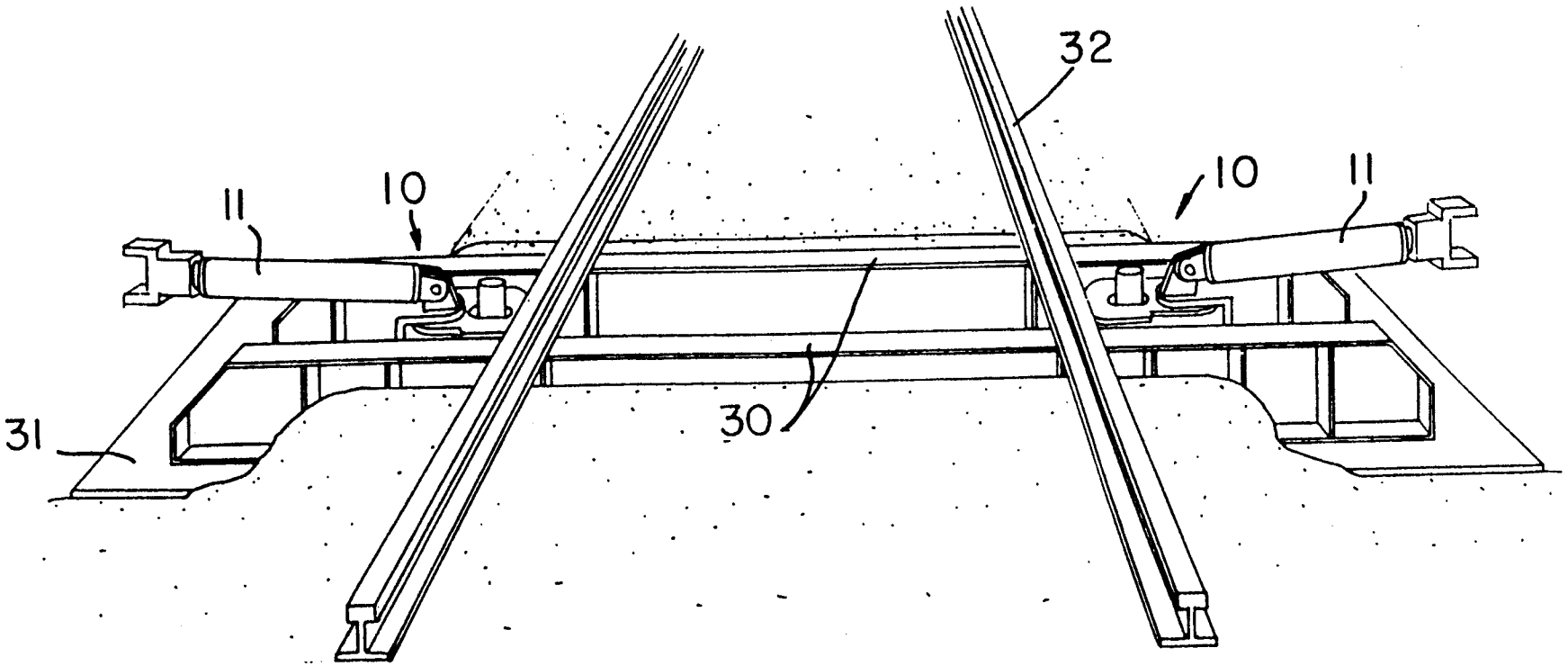
FIG. 1 is a perspective view of the door closer of the present invention.

The door closer in FIGS. 1–4 has two closer arm assemblies 10, one for each side of a railroad car door (not shown). The closer arm assemblies 10 each have a closer jack 11 which can be moved from a storage position 20, where the jacks lie horizontal and perpendicular to the rails, to a forward or rearward closing position 21, 22.

The door closer arm assemblies 10 are mounted to a frame. The frame has two load bearing members 30 mounted on a solid foundation 31 under a section of a track 32. The load bearing members extend between and perpendicular to the rails. The load bearing members extend outside the rails by a distance sufficient to attach a closer arm assembly 10 on each side. The two load bearing members are spaced apart and connected by two arm mount members 33 which extend parallel to the tracks, each arm mount member is located substantially adjacent to each rail.

The frame described above may be modified to have only one load bearing member, or more than two load bearing members and may have additional connecting members parallel to the arm mount members. The solid foundation 31 may be made of metal or timber, or the like, but preferably is made of concrete. The load bearing members may be mounted to the frame by bolts through discrete mounting pads 34 or by bolts through flanges on the bottom surface of the load bearing members, depending upon the need to distribute the applied load over a larger area of the foundation.

Each arm mount member has a mounting bracket 35 which extends laterally away from the adjacent rail. The bracket has a top flange 36 and a bottom flange 37. The closer arm assembly 10 is attached to the arm mount member by the mounting bracket 35. A pivot shaft 12 passes vertically through the two flanges of the mounting bracket. A pivot bracket 13 is attached to the pivot shaft 12. The closer jack 11 is connected to the pivot bracket 13, and is rotated about the pivot shaft 12 by an electric or hydraulic swing motor 15, preferably, a low speed, high torque hydraulic motor. The swing motor 15 is attached to the mounting bracket between the pivot shaft and the arm mount member and has a spur gear 16 attached to its output shaft. The swing motor spur gear engages a pivot spur gear 17 attached to the pivot shaft. Activating the swing motor 15 thus pivots the pivot bracket 13 and closer jack 11 about the pivot shaft 12.

Figure 2:
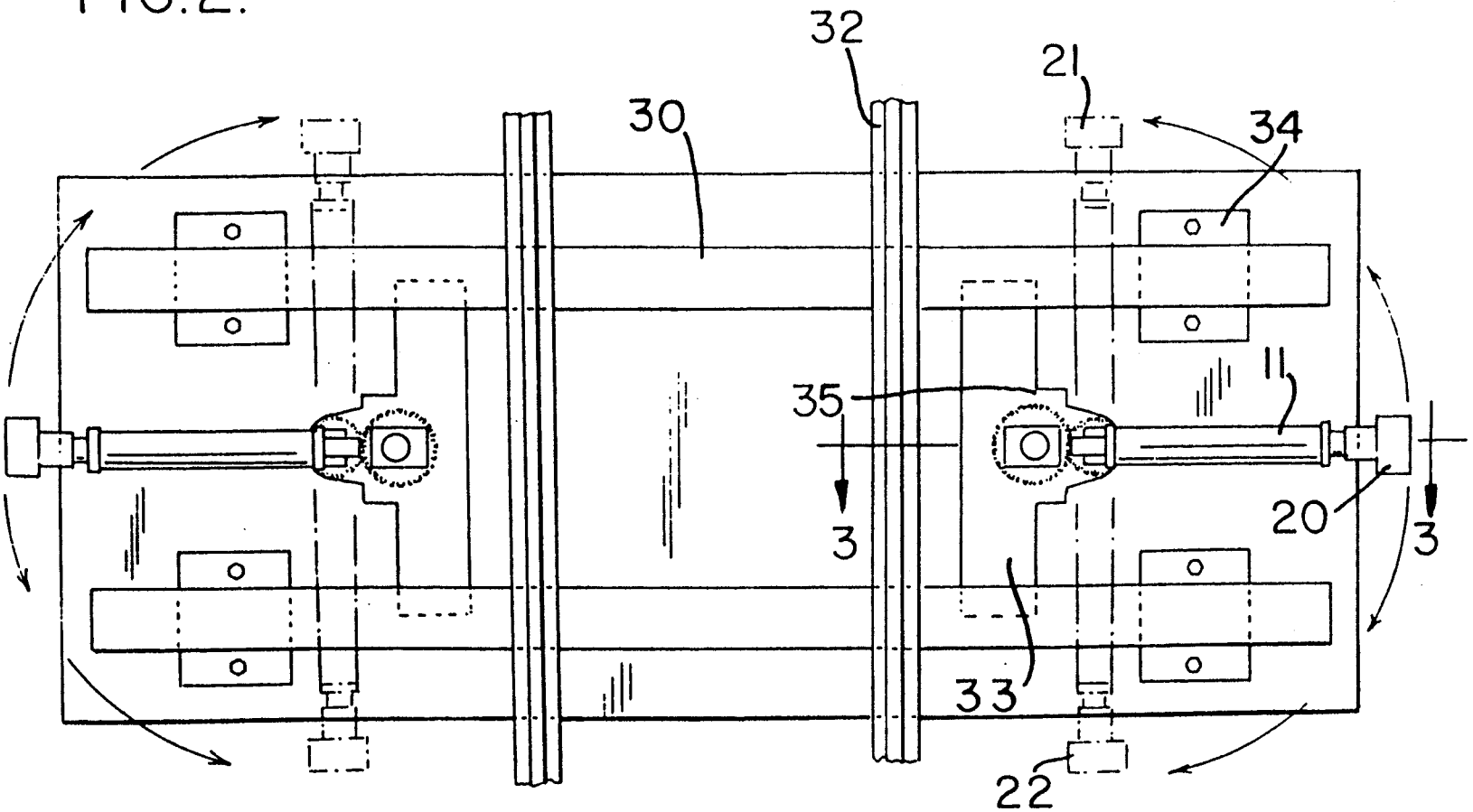
FIG. 2 is a plan view of the present invention.

The closer jack 11 can be pivoted by the swing motor 15 until the closer jack 11 is at least parallel to the adjacent rail, as shown by the first closing position 21 in FIG. 2, so that it may be used to close the door of one railroad car. The closer jack can also pivoted at least 180° from the first closing position to be at least parallel with the adjacent rail in the other direction, as shown by the second closing position 22, so that it may close the door of the adjacent car. When not in use, the closer jack 11 is pivoted to the storage position, as shown by position 20, where the closer jack lies perpendicular to the tracks.

Figure 3:
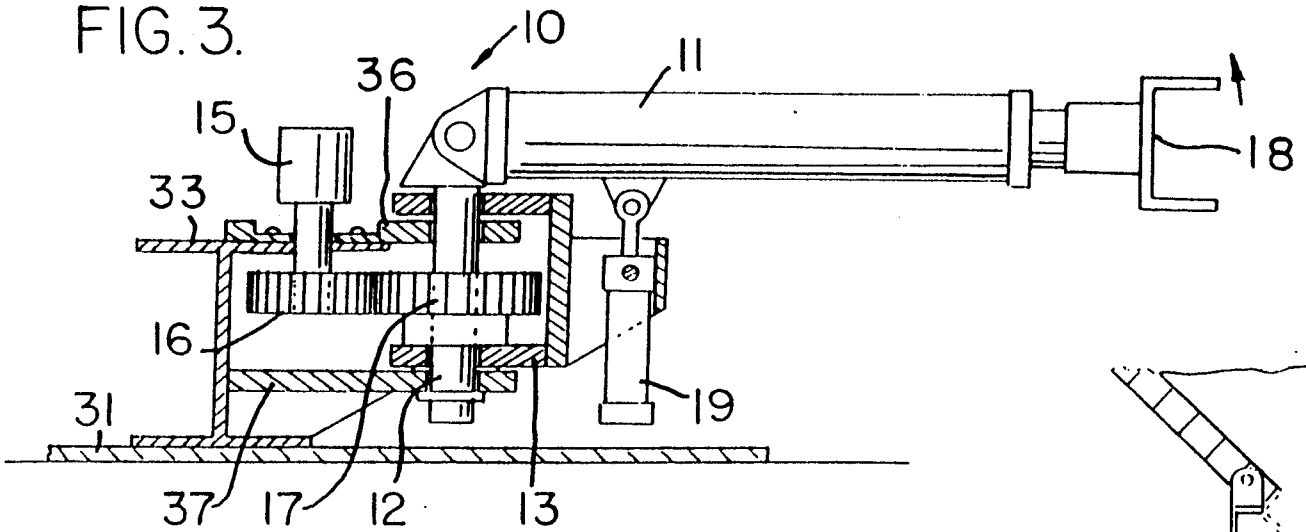
FIG. 3 is a partial cross-sectional view of FIG. 2 at position III—III.
Figure 4:
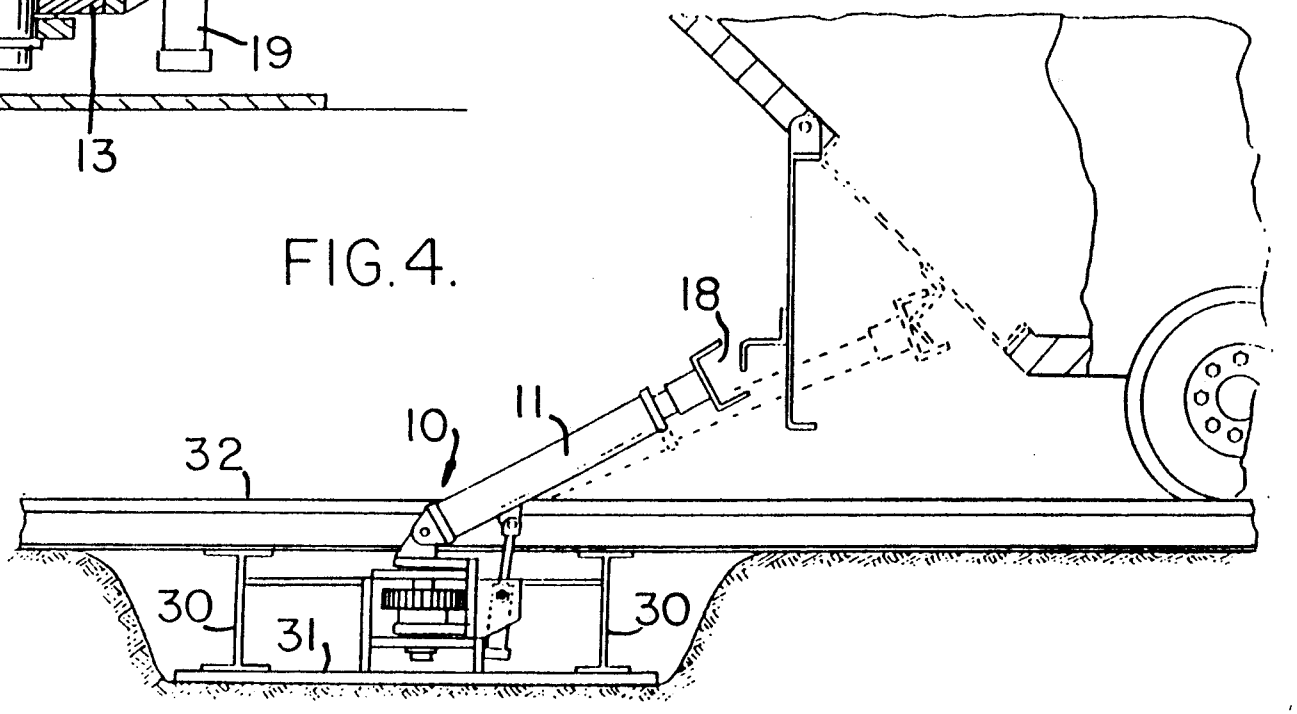
FIG. 4 is an end view of the door closer in a closing position.

Referring to FIG. 3, the closer jack 11 is a hydraulic cylinder and piston, the cylinder end of which is pivotally connected to the pivot assembly 13 along the axis of rotation of the pivot shaft 12. The piston end of the closer jack has a shaped fitting 18 for interfacing with closer fittings on the rail car doors. Preferably, the fitting is "C" shaped which may engage with a "Z" shaped stiffener on the rail car door, as shown in FIG. 4. The lift jack 19 is provided on the pivot bracket 13 and is attached at one end to the closer jack. The lift jack 19 is also a hydraulic cylinder and piston connected to the pivot bracket 13 at one end and to the closer jack 11 at the other. When activated, the lift jack lifts the closer back 11 about its pivot point and thus changes the angle of the closer jack relative to the rails so that it is at the proper angle to interface with the rail car door stiffener, as shown in FIG. 4. The closer jack 11 may then be extended to engage the closer fitting 18 with the door stiffener and push the door into the closed position where it may be latched and locked.

A single door of a railroad car can be closed by using two closer assemblies of the same door closer system operating simultaneously on the same door. Alternatively, two door closer assemblies of the same door closer system may be operated independently to each close a different door, so that two doors may be closed at the same time. Thus, one door closer assembly is operated to close the door of one railroad car while a second closer assembly is operated to close the door of the adjacent car.

After a door of a forward car has been closed, the closer jack 11 may be retracted to disengage the closer jack fitting 18 from the door and pivoted 180° by the swing motor 15 to be in a rearward push position to close the door of the adjacent rearward car. Thus, the closer can close the doors of two adjacent cars without moving the rail cars.

Figure 5:
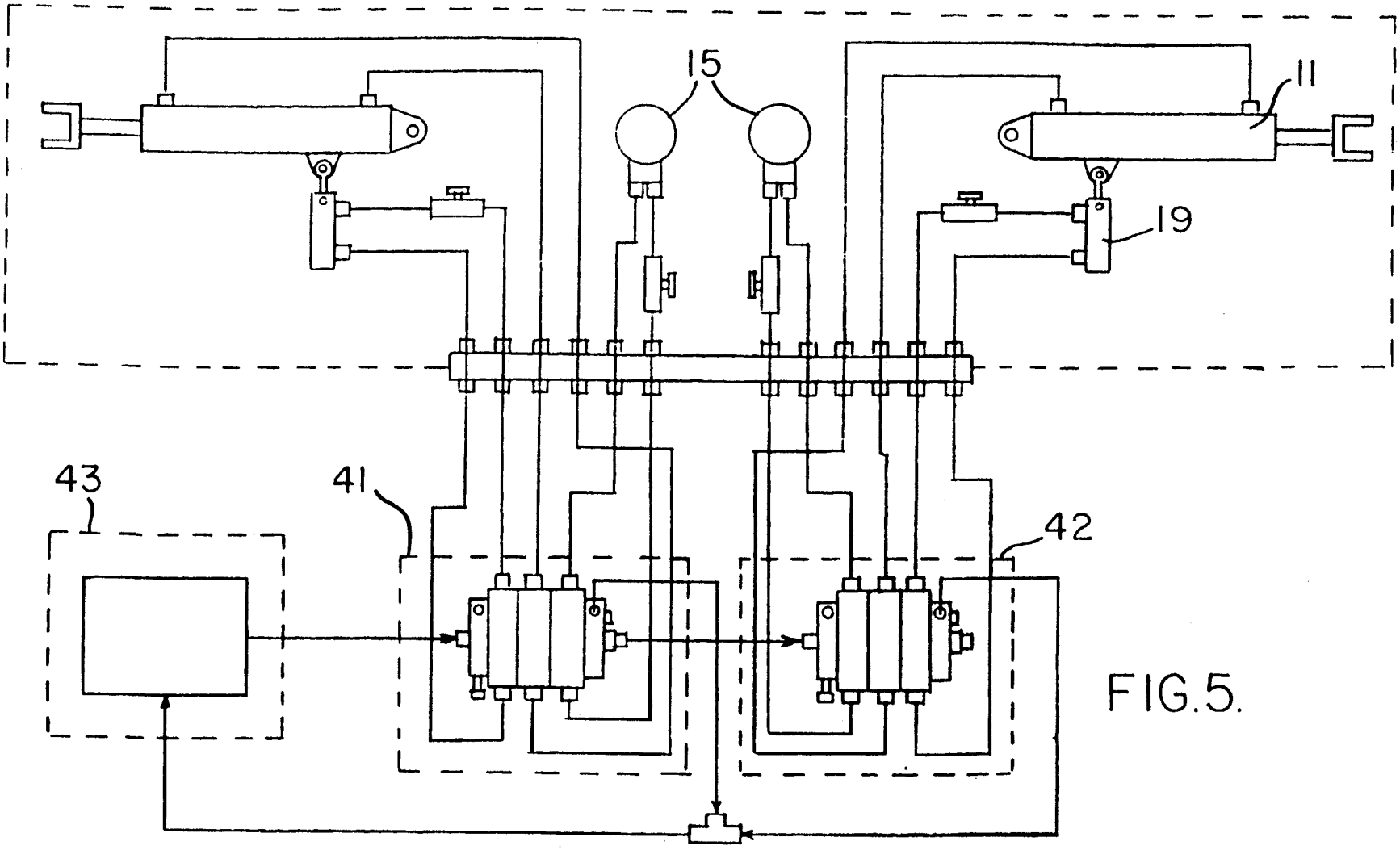
FIG. 5 is a schematic of the hydraulic assembly of the present invention.

The two closer assemblies are independently controlled by two remote control banks (see FIG. 5). The left control bank 41 operates the left closer assembly and the right control bank 42 operates the right assembly. The control banks may be both located on the same side of the track, but preferably are on opposite sides of the track respectively to permit good visibility and control of the nearby jack. Also, preferably, the door closer is powered entirely by a hydraulic power pack 43, thus there is no requirement for electric power at the closer thus reducing the chance of fire. The left and right control banks each have three control valves, one valve for each of the three motions: pivot; lift; and close. The hydraulic circuits for the door closure are shown in FIG. 5.

It is not necessary that the invention have two closer assemblies. One closer assembly adapted to contact a door at the proper position may be sufficient. Alternatively, more than two closer assemblies can be used. Also, by extending the length of the load bearing members, the door closer assemblies can be mounted further from the track and may be used to press inwardly toward each other and may be used to close side doors of railroad cars (not shown). By adding a fourth actuator, the closer assemblies can be made to move along the load bearing members perpendicularly to the tracks so as to be used alternatively to close end doors and side doors of railroad cars (not shown).

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. A door closer comprising:

two closer assemblies for closing a door of a railroad car in a train, one of the closer assemblies being disposed adjacent a first rail of a section of the railroad track, and the other closer assembly being disposed adjacent a second rail of the section of railroad track, each closer assembly comprising:

a swing bracket;

a swing means for rotating the swing bracket about a vertical axis;

a closer member for contacting and closing the door, the closer member being pivotally mounted about a horizontal axis to the swing bracket; and a lifting means for pivoting the closer member about the pivot mounting, whereby the closer member can be rotated about the vertical axis by the swing means and pivoted about the horizontal axis by the lifting means to contact and close a door of an adjacent railroad car in the train, and means for simultaneously operating the two closer assemblies to close a singe door of one of the railroad cars.

2. A door closer according to claim 1 wherein each closer member includes a hydraulic jack comprising a hydraulic cylinder and a piston.

3. A door closer according to claim 1 wherein each lifting means includes a hydraulic jack comprising a hydraulic cylinder and a piston.

4. A door closer according to claim 1 wherein each swing means includes a low speed high torque hydraulic motor.

5. A door closer according to claim 1 wherein each swing means can rotate the closer member through an arc of substantially 180 degrees between a position adjacent a door of a forward car in a train and a position adjacent a door of a rearward car in a train to selectively close the respective doors without moving either car.

6. A door closer according to claim 1 wherein each closer member further comprises a generally C-shaped fitting at an end thereof remove from said pivot mounting, for selectively engaging the door of the railroad car.

7. A door closer according to claim 1 whereby the means for simultaneously operating the two closer assemblies can also simultaneously operate one of the closer assemblies to close the door of the railroad car and the other closer assembly to close the door of the adjacent railroad car.

8. A door closer for closing a door of a railroad card in a stationary train comprising:

a frame assembly extending under rails of a railroad track;

a first closer assembly mounted to a first end of the frame assembly adjacent to a first rail, and a second closer assembly mounted to a second end of the frame assembly adjacent to a second rail, each closer assembly comprising:

a swing bracket;

a swing means for rotating the swing bracket about a vertical axis;

a closer member for contacting a closing a door of a railroad car in the train, the closer member being pivotally mounted about a horizontal axis to the swing bracket; and a lifting means for pivoting the closer member about the pivot mounting, whereby each closer member can be rotated at least approximately 180° about the vertical axis by the swing means and pivoted about the horizontal axis by the lifting means to also contact and close a door of an adjacent railroad car in the train without moving either railroad car.

9. A door closer according to claim 8 wherein the closer members and the lift means each include a hydraulic jack which comprises a hydraulic cylinder and a piston.

10. A door closer as in claim 8 wherein each swing means includes a low speed high torque hydraulic motor.

11. A door closer according to claim 8 wherein the closer members, lift means and swing means are each hydraulic devices powered by a hydraulic power pack.

12. A door closer according to claim 11 and further comprising:

a first control bank for controlling the first closer assembly; and a second control bank for controlling the second closer assembly.

13. A door closer for closing doors of railroad cars in a stationary train, comprising:

first and second closer means positioned adjacent first and second rails, respectively, of a railroad track for exerting a force in a first closing direction on a door of a first railroad car in the train;

first and second swing means for rotating the first and second closer means, respectively, such that each closer means can contact a door of a second railroad car in the train and exert a force in a second closing direction opposite to the first closing direction, and;

means for simultaneously operating the first and second closer means to close at least one of the doors.

14. A door closer according to claim 13, wherein each closer means includes a closer arm and means for extending said closer arm to push one of the doors to a closed position.

* * * * *